US005147681A

United States Patent [19]

Maroney

[11] Patent Number: 5,147,681

[45] Date of Patent: Sep. 15, 1992

[54] METHOD OF PAINTING AND PRINTING GARMENTS AND FABRIC

[75] Inventor: Dennis J. Maroney, Studio City, Calif.

[73] Assignee: L.A. Air Line, Inc., Vernon, Calif.

[21] Appl. No.: 509,164

[22] Filed: Apr. 13, 1990

[51] Int. Cl.[5] ..... B05D 3/02; B05D 3/06; B05D 5/00

[52] U.S. Cl. ..... 427/56.1; 427/260; 427/262; 427/265; 427/280; 427/288; 427/381

[58] Field of Search ..... 427/288, 56.1, 381, 427/260, 262, 265, 280; 118/314, 324, 64, 66, 643; 34/4, 41

[56] References Cited

U.S. PATENT DOCUMENTS

| | | | |
|---|---|---|---|
| 3,942,340 | 3/1976 | Korkby | 68/3 R |
| 4,022.338 | 5/1977 | Laursen | 198/463.3 X |
| 4,727,655 | 3/1988 | Jacobi, Jr. | 34/4 |

OTHER PUBLICATIONS

Hall, J. D., "Radiant Heat and Its Application", Technical Association Papers, Series XXV, presented at TAPPI annual meeting, New York, N.Y., Feb. 16–19, 1942, pp. 213–217.

*Primary Examiner*—Evan Lawrence
*Attorney, Agent, or Firm*—Rapkin, Gitlin & Moser

[57] ABSTRACT

The method of the present invention begins with the unloading of the garments delivered by the customer. After unloading, the garments are sorted and counted and then placed on moveable racks for transportation to a separate storage area nearby. Selected garments are then moved from the storage area to a temporary receiving area near zones known as painting cells, where the garments are taken and hung from hooks attached to a variable speed electronically operated overhead track conveyor. The conveyor moves the garments along an oval shaped track pattern at a constant speed as paint is applied by workers stationed at various locations along the conveyor route. Various paint application methods are utilized during this stage of the operation, including the use of spray bottles and airbrushes. The garments are then removed from the hooks attached to the conveyors circulating inside the painting cells and placed on another conveyor, which transports the garments upwardly into the ceiling areas of the production facility where the conveyor track slowly winds around portions of the interior of the building. There the garments continue to circulate through the heated air beneath a series of radiant tube type heaters allowing sufficient time for the paint to dry. The garments are unloaded from the ceiling conveyor and then conveyed through an oven for curing under extreme heat. When dry, and the paint is properly cured, the garments are removed to a holding area for shipment to the customer.

5 Claims, 1 Drawing Sheet

METHOD OF PAINTING AND PRINTING GARMENTS AND FABRIC

FIELD OF INVENTION

The present invention relates generally to fabric and wearing apparel and more particularly to a novel and efficient method of adhering paint pigments to finished garments utilizing a variety of painting and printing applications.

DESCRIPTION OF THE PRIOR ART

Apparel painting, printing and silk screening methods in the prior art include direct application of paint to fabric or the garment through the use of brushes, sponges, rollers, spray applicators and a variety of other creative and conventional means. In the past, apparel painting on a mass productive scale included methods which were inefficient and cumbersome. For example, garments placed on ordinary metal hangers were hung in long rows before laborers who applied paint substances literally by hand using any of the aforesaid or similar methods. In a large operation, one could observe literally hundreds, if not thousands, of garments of all sizes and shapes strung on long lines one row after another. Clothespins, though more often metal hangers, were used to hang the garments on lines of rope or wire strung from one end of a room to the other. Lines of workers passed by rows of garments applying the paint by hand to one side as they moved along. The process was then repeated row by row along the reverse side of the garments. Understandably, the process proceeded no faster than the pace of the slowest worker. When the application of the paint was complete, the same workers would lift the garments off the rope or wire and then walk them over to another location where they were hung to dry naturally. During the transfer, there were a great many opportunities for the wet paint to smear creating defects in the designs on the garments rendering them, in many cases, worthless. Drying methods in the prior art, particularly as they regarded beaded paint applications (i.e., paint that is sprayed or squirted onto a garment as compared to paint which is pressed on the garment using, for example, roller, rag, or sponge applicators), were often ineffective and ultimately very costly. Although special drying areas were designated for the garments, including an overflow location situated, for example, above the production area, drying time, especially regarding beaded paint applications, was directly and significantly affected by a variety of extrinsic factors, including cold temperatures, rain and generally humid weather conditions. Sometimes, the weather slowed the drying process so significantly, that it would be necessary to halt production and dismiss the workers for the balance of the work shift.

Thus, the old process, which is susceptible to adverse weather conditions, labor intensive, and includes unnecessarily complicated material flow patterns and excessive product handling, generated low production volumes (usually no more than 5,000–10,000 garment units per day) due to inefficient and extremely slow methods of operation. The lack of job specialty areas also contributed to the problems associated with the old methods.

The method of the present invention constitutes a vast improvement over the prior art in that it offers, among other things, increased production output (e.g., 15,000–30,000 garment units per day) reduction in production time, reduced labor requirements (e.g., 20%–30%), production versatility, speed control, and opportunities for design creativity and job specialties.

The method of the present invention involves several production stages, beginning with the unloading of the garments delivered by the customer. After the garments are unloaded, they are sorted and counted and then placed on moveable racks that transport them to a separate storage area nearby. Selected garments are then moved from the storage area to a temporary receiving area near zones known as painting cells, where the garments are taken and hung from hooks attached to a variable speed electronically operated overhead track conveyor. The conveyor moves the garments along an oval shaped track pattern at a constant rate of speed as paint is applied by workers stationed at various locations along the conveyor route. Various paint applications are utilized during this stage of the operation, including the use of spray bottles, sponge applicators and airbrushes, among others. The result is a beaded or bubbled effect, since the paint, at least initially, "sits" on top of the fabric appearing almost bead or bubblelike while awaiting the slow process of absorption into the fabric.

After the garments are painted, they are removed from the hooks attached to the conveyors circulating inside the painting cells and placed on another conveyor, which transports the garments upwardly into the ceiling areas of the production facility where the conveyor track slowly winds around portions of the interior of the building. There the garments continue to circulate through the heated air beneath a series of radiant tube type heaters allowing sufficient time for the paint to dry. The infra-red radiant space heaters that are used in the process are conventional in technology and design. They are tubular (about 20 to 40 feet in length), generally U-shaped, and include overhead independent polished bright aluminum reflectors, which direct the soft warm heat radiated from the tube to the garments circulating below.

The garments are unloaded from the ceiling conveyor and then placed on a separate belt conveyor and subjected in an oven to extreme heat. When dry, and the paint is properly cured, the garments are placed on hangers or the like and removed to a holding area to await shipment to the customer.

Thus, the improvements offered by the method comprising the present invention include the means to efficiently and effectively paint, print and silk screen large volumes of garments or swatches of fabric wherein the garments or fabric are exposed to infra-red radiant heated air over a prolonged period to effect proper drying of the applied paint pigments. The method of the present invention also accommodates the means for additional paint applications upon flat conveyors, if desired, and coordinated processes that allow exposure of the painted garments to intense heat to achieve proper curing. Overall quality control of the painted garment is greatly improved while substantially maximizing product output in the process.

The advantages and distinctions of the method of the present invention over the prior art will become clearly evident in the following disclosure.

SUMMARY OF THE INVENTION

The method of the present invention involves several production stages, beginning with the unloading of the garments delivered by the customer. After the garments are unloaded, they are sorted and counted and then placed on moveable racks that transport them to a separate storage area nearby. Selected garments are then moved from the storage area to a temporary receiving area near zones known as painting cells, where the garments are taken and hung from hooks attached to a variable speed electronically operated overhead track conveyor. The conveyor moves the garments along an oval shaped track pattern at a constant rate of speed as paint is applied by workers stationed at various locations along the conveyor route. Various paint applications are utilized during this stage o the operation, including the use of spray bottles and airbrushes, among others. The result is a beaded or bubbled effect, since the paint, at least initially, "sits" on top of the fabric appearing almost bead or bubblelike while awaiting the slow process of absorption into the fabric.

After the garments are painted, they are removed from the hooks attached to the conveyors circulating inside the painting cells and placed on another conveyor, which transports the garments upwardly into the ceiling areas of the production facility where the conveyor track slowly winds around portions of the interior of the building. There the garments continue to circulate through the heated air beneath a series of radiant tube type heaters allowing sufficient time for the paint to dry. The infra-red radiant space heaters that are used in the process are conventional in technology and design. They are tubular (about 20 to 40 feet in length), generally U-shaped, and include overhead independent polished bright aluminum reflectors, which direct the soft warm heat radiated from the tube to the garments circulating below.

The garments are unloaded from the ceiling conveyor and then placed on a separate belt conveyor and subjected in an oven to extreme heat. When dry, and the paint is properly cured, the garments are placed on hangers or the like and removed to a holding area to await shipment to the customer.

Accordingly, an object of the present invention is to provide a method of manufacture to facilitate the painting, printing and silk screening of garments and fabric and substantially reduce production and labor time in connection therewith.

Another object of the present invention is to provide a method of manufacture for the painting, printing and silk screening of garments and fabric that is capable of generating a large volume output.

Another object of the present invention is to provide a method of manufacture for the painting, printing and silk screening of garments and fabric that combines in specified sequences revolving tract and flat conveyors for the paint application stages and ceiling tract and belt conveyors for the drying and curing stages.

Still another object of the present invention is to provide a method of manufacture for the painting, printing and silk screening of garments and fabric that is convenient and efficient to operate.

Still yet another object of the present invention is to provide a method of manufacture for the painting, printing and silk screening of garments and fabric that is simple in design and easily implemented.

Still yet another object of the present invention is to provide a method of manufacture for the painting, printing and silk screening of garments and fabric that substantially improves quality control of the finished product.

Still yet another object of the present invention is to provide a method of manufacture for the painting, printing and silk screening of garments and fabric that substantially improves quality control of the finished product by utilizing a novel and substantially improved drying system combining infra-red radiant heated air and intense oven temperatures.

Other objects and advantages of the present invention will become apparent in the following specifications when considered in light of the attached drawing wherein a preferred embodiment of the invention is illustrated.

DETAILED DESCRIPTION OF THE PREFERRED EMBODIMENT

Figure 1:
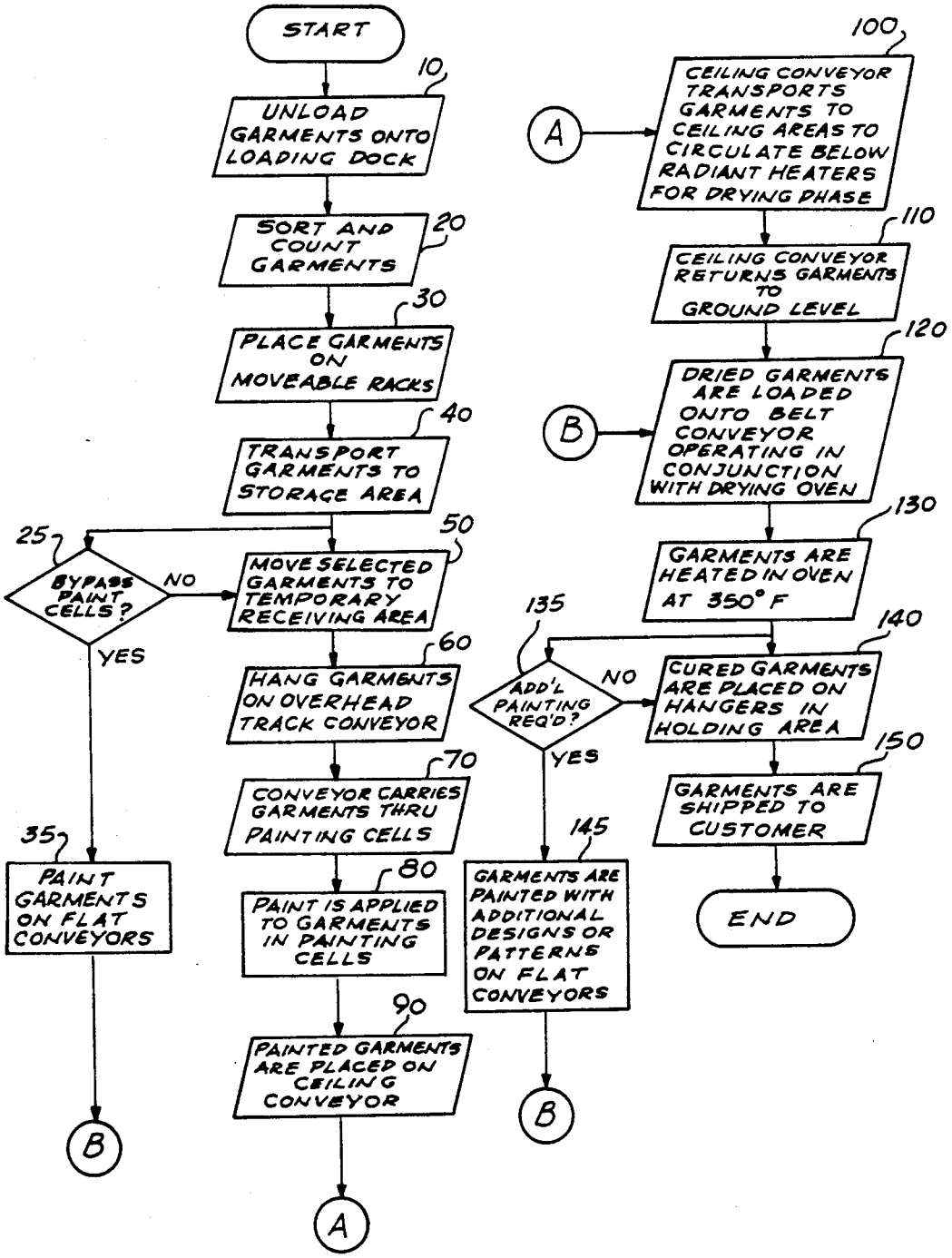
FIG. 1 is a flow sheet illustrating the method, including alternative embodiments, of the present invention.

The method of the present invention, as illustrated in the flow chart in FIG. 1, involves several production stages, beginning with the unloading of the garments or fabric (hereinafter "garments") from trucks or other vehicles (10), which typically takes place at the site of the unloading bay located at a designated area of the production facility. At this stage, the garments are sorted and counted (20) and placed on moveable racks (30). The garments are then transported to a holding area (40), which has storage capability for 50,000–70,000 garments on racks situated four levels high. Selected garments are then moved from the storage area to a temporary receiving area (50) near zones known as painting cells, where the garments are hung from hooks attached to a variable speed electronically operated overhead track conveyor (60), which is designed in the shape of an oval. The conveyor moves the garments along at a constant rate of speed (70) as paint is applied by workers stationed at various locations along the conveyor route (80). Relative capacities of the painting cells on the average are, for example, five shirt units or twelve jean units per minute assuming a conveyor track length of approximately seventy feet and a distance of approximately two to three feet between units. Approximately 30,000 garments can be processed daily at this rate, almost three times the number that are capable of being processed by prior art methods. Various paint applications are utilized during this stage of the operation, including the use of manual spray bottles or spring supported spray guns, sponge applicators, airbrushes and even "catsup" bottles, which provide the effect of a random "flicked on" look. Conventional stretch wire may be used in place of the conveyor, though this would likely reduce the overall efficiency of the operation.

After the garments are painted, they are removed from the painting cells and placed on a conveyor (90) approximately 1600 feet in length (not including sections for loading and unloading garments), which transports the garments to the ceiling areas where the conveyor track winds around portions of the interior of the building. There the garments continue to circulate through the heated air beneath a series of radiant tube type heaters (100) allowing sufficient time for the paint to dry. The infrared radiant space heaters that are used in the process are conventional in technology and design. They are tubular (about 20 to 40 feet in length), generally U-shaped, and include overhead independent polished bright aluminum reflectors, which direct the soft warm heat radiated from the tube to the garments circulating below. Unlike in the past, adverse weather conditions, such as rain, humidity and the cold, no longer have any significant effect on the drying process. The radiant heaters utilized are placed strategically to ensure adequate heat distribution around the circulating garments. Thus, drying time, which once took as much as three to four hours (often more if weather conditions interfered), is reduced to a range of only forty-five to ninety minutes. Night production, which was not feasible in the past because of the influence of cooler evening temperatures, has now become a regular part of the production process utilizing the methods of the present invention.

The approximate turning radius for the conveyor to avoid contact between the garments during the radiant heated air drying process is approximately two feet. This is adequate for most types of garments, though items having special requirements can be accommodated by adjusting the radius accordingly.

Proper absorption of the paint into the fibers of the fabric is critical to insure adequate adhesion and binding, an absolute and essential requirement to prevent the paint from fading in the sunlight and to prevent crocking, the name given to the breaking and chipping of the paint if not allowed to cure properly. Proper absorption into the fabric is also necessary to ensure and prolong the paint's resistance to fading and deterioration when subjected to successive cleanings and washings, a concept known as "washability."

After the paint is allowed to dry for a sufficient time under the series of overhead radiant heaters, the garments are unloaded from the ceiling conveyor. Off loading of the garments from the ceiling conveyor, as with loading, occurs at ground level (110). The garments are then placed on a belt conveyor (120) and subjected in an oven to extreme heat of approximately 350 degrees fahrenheit for about two minutes (130). When dry, and the painted or silk screened design is completely cured, the garments are placed on hangers and removed to a holding area (140) to await shipment to the customer (150).

A first alternative embodiment of the method of the present invention involves the application of more paint to create additional designs or patterns on the garments (135) after they are exposed to the intense oven temperatures. In this regard, the garments are placed on large rectangular flat conveyers, where additional designs or patterns are applied over the original work using a variety of techniques, including roller printing, sponge and rag painting, and conventional applicators, including spray bottles and brushes (145). As in the painting cells, workers stand alongside the conveyor and paint the garments as they move past at a constant rate of speed.

A second alternative method in accordance with the present invention comprises a combination of the first two, as above, absent any use of the painting cells (25). The paint is thus applied to the garments on the flat conveyors (35) through the use of rollers, rags, sponges, etc., as heretofore described, and either placed on the belt conveyor in the oven to dry under the intense heat or, if appropriate, hung to dry on the circulating ceiling conveyors under the radiant heated air generated from above. The garments are then removed to the shipping area to be held for eventual delivery to the customer.

Different paint applications normally require different drying times and methods. For example, paint applied to a garment hanging from a conveyor is usually sprayed, squirted or flicked on. Paint applied in this manner "sits" atop the fabric and is not initially absorbed into the fabric, which is essential to adhesion and color fastness. Thus, for example, to ensure resistance to fading and crocking and sufficient time for the paint to properly impregnate the fabric fibers, as already explained, the paint must be allowed to dry slowly at a relatively constant temperature before it can be subjected to intense heat inside the oven. In contrast, paint applied by rollers, sponges, and the like, is actually pressed between the fibers of the fabric, thus obviating the need for utilizing the slower drying process. Normally, paint applied in this manner requires only the quick and intense oven heat in order to cure properly.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

I claim:

1. In an enclosed structure, a method for applying paints and pigments to the surface of garment fabric and curing and drying the paints and pigments thereon, which comprises:

(a) Loading garments on a means to transport said garments to a first storage area;

(b) Sorting and counting said garments;

(c) Transporting said garments to said first storage area;

(d) Transporting said garments from said first storage area to a first painting area containing a first conveyer from which said garments are individually hanged and secured;

(e) Applying paints or pigments to said garments as they move within the first painting area along the first conveyer using one or more applicator means so that the paints or pigments initially lay on the surface of the garment fabric;

(f) Transferring said garments from the first conveyor to a second conveyor which transports said garments to the ceiling area of said enclosed structure to permit said garments to circulate through the heated air beneath a series of radiant tube-type heaters to enable the paint or pigments thereon to be slowly absorbed into the fabric and have sufficient time to dry;

(g) Placing said garment on a belt conveyer to subject the applied paints or pigments thereon to intense heat inside a dryer to enable the paints or pigments to cure; and, (h) Transporting the dried garments from the belt conveyer to a second storage area for eventual shipment.

2. The invention of claim 1 wherein said first, second and belt conveyers are electronically powered.

3. The invention of claim 1 wherein said applicator means comprise a bottle, spray bottle, spray gun, airbrush or sponge.

4. The invention of claim 1 wherein said belt conveyor is utilized in conjunction with a gas powered air dryer.

5. A method for painting, printing and silk screening garments in an enclosed structure through the application of paints and pigments to the surface of garment fabric which comprises:

(a) Loading garments on a means to transport said garments to a first storage area;

(b) Sorting and counting said garments;

(c) Transporting said garments to said first storage area;

(d) Transporting said garments from said first storage area to a first painting area containing a first electronically powered conveyor from which said garments are individually hanged and secured;

(e) Applying paints or pigments to said garments as they move within the first painting area along the first electronically powered conveyor using one or more applicator means so that the paints or pigments initially lay on the surface of the garment fabric;

(f) Transferring said garments from the first electronically powered conveyor to a second electronically powered conveyor which transports said garments to the ceiling area of the enclosed structure to permit said garments to circulate through heated air beneath a series of radiant tube-type heaters to enable the paint or pigments thereon to be slowly absorbed into the garment fabric and have sufficient time to dry;

(g) Placing said garments on a belt conveyor to subject the applied paints or pigments thereon to intense heat inside a dryer to enable the paints or pigments to cure;

(h) Placing said garments on a flat conveyor for application of additional paints or pigments over the original painted or pigmented fabric surfaces through the utilization of one or more techniques, including roller printing, sponge painting, rag painting, spray bottles or brush application;

(i) Placing said garments on a belt conveyor to subject the applied paints or pigments thereon to intense heat inside a dryer to enable the additional paints or pigments to cure; and (j) Transporting the garments from the belt conveyor to a second storage area for eventual shipment.

* * * * *